US005574430A

United States Patent [19]

Ott et al.

[11] Patent Number: 5,574,430

[45] Date of Patent: Nov. 12, 1996

[54] MONITORING SENSOR

[75] Inventors: Reinhold Ott, Europaplatz 20, D-70565 Stuttgart; Christoph Rossmann, Gauitsch, both of Germany

[73] Assignee: Reinhold Ott, Stuttgart, Germany

[21] Appl. No.: 374,143

[22] Filed: Jan. 17, 1995

[30] Foreign Application Priority Data

Jan. 18, 1994 [DE] Germany ..... 44 01 325.6

[51] Int. Cl.[6] ..... G08B 13/14

[52] U.S. Cl. ..... 340/568; 340/566; 340/572; 340/665

[58] Field of Search ..... 340/572, 568, 340/691, 693, 566, 557, 555, 556, 652, 665

[56] References Cited

U.S. PATENT DOCUMENTS

| | | | |
|---|---|---|---|
| 3,534,356 | 10/1970 | Bagno | 340/566 |
| 3,582,692 | 6/1971 | Palini | 340/566 |
| 3,863,250 | 1/1975 | McCluskey, Jr. | 340/566 |
| 4,000,488 | 12/1976 | Ephraim | 340/280 |
| 4,262,284 | 4/1981 | Stieff et al. | 340/568 |
| 4,734,034 | 3/1988 | Maness et al. | 340/665 |
| 4,772,878 | 9/1988 | Kane | 340/568 |
| 4,991,145 | 2/1991 | Goldstein et al. | 340/566 |
| 5,003,292 | 3/1991 | Harding et al. | 340/568 |
| 5,055,827 | 10/1991 | Philipp | 340/568 |
| 5,062,916 | 11/1991 | Aufderheide et al. | 156/269 |
| 5,120,097 | 6/1992 | Fattori et al. | 292/318 |
| 5,134,386 | 7/1992 | Swanic | 340/557 |
| 5,172,098 | 12/1992 | Leyden et al. | 340/691 |
| 5,289,559 | 2/1994 | Wilson | 385/136 |
| 5,367,289 | 11/1994 | Baro et al. | 340/566 |

FOREIGN PATENT DOCUMENTS

| | | |
|---|---|---|
| 0260330A1 | 3/1988 | European Pat. Off. . |
| 0663656A1 | 7/1995 | European Pat. Off. . |
| 8218333 | 9/1982 | Germany . |
| 3302459 | 11/1983 | Germany . |
| 3343436 | 6/1985 | Germany . |
| 3419526 | 11/1985 | Germany . |
| 8905481 | 6/1989 | Germany . |
| 4221686 | 1/1994 | Germany . |
| 4310809 | 10/1994 | Germany . |

*Primary Examiner*—Jeffery Hofsass
*Assistant Examiner*—Benjamin C. Lee
*Attorney, Agent, or Firm*—Edward J. Timmer

[57] ABSTRACT

A monitoring sensor for articles susceptible to theft, comprising a sensor element for monitoring a proper contact of the sensor with the article and a connecting cable for connecting the sensor to a monitoring circuit of a theft protection system is proposed. During disconnecting of the proper contact with the article, the sensor makes available a measured variable, the alteration in which can be evaluated by the monitoring circuit as an alarm situation. To enable the sensor to be produced in a flat type of construction and also to be easily connected to curved surfaces of an article to be protected, the sensor and the sensor element are of a flexible design, whereby any alteration in shape during disconnecting of the proper contact between sensor and article results in an alteration in the shape of the contact surface element and in an alteration in the measured variable.

20 Claims, 4 Drawing Sheets

MONITORING SENSOR

The invention relates to a monitoring sensor for articles susceptible to theft, comprising a sensor element for monitoring a proper contact of the sensor with the article to be protected and a connecting cable for connection of the sensor to a monitoring circuit of a theft protection system. The sensor provides an electrical measured variable during disconnecting of the proper contact with the article to be protected and the alteration in this variable can be evaluated by the monitoring circuit as alarm situation.

Monitoring sensors of this type with associated theft protection systems are used, above all, in stores selling radio and television equipment, video equipment, telephone systems etc., in which a large number of demonstration models are kept ready for operation and trial use by the customers. In order to avoid corresponding losses of such equipment due to theft, the equipment is connected to theft protection systems with the above-mentioned monitoring sensors. When an alteration in the measured variable occurs, which is brought about by the proper contact with the article being disconnected, these systems trigger an alarm and thus effectively prevent any theft of the protected device or the protected article of merchandise.

Monitoring sensors of the type specified at the outset are known from DE 33 02 459 A1. These are connected via a connecting cable to a monitoring circuit of a theft protection system. The sensors have as sensor element for monitoring the proper contact of the sensor with the article to be protected a plurality of special plug connections which contain a microswitch integrated therein, the switching state of which alters when the sensor is removed from the article. The alteration of the switching state is detected in the form of a measured variable by the monitoring circuit and evaluated as an alarm situation.

In order to be able to use the monitoring sensors in various different ways, a so-called adhesive sensor, such as that known from DE 42 21 686 A1, has also been suggested instead of the plurality of plug connection parts. The sensor has a rigid housing which is adhesively connected to the article, whereby a switch arranged on the underside of the sensor is actuated as the housing is stuck on. The switch returns to its initial position and therefore provides the monitoring circuit with a measured variable in the form of an interrupted electric conductor with infinite resistance when the proper connection between sensor and article is released again.

U.S. Pat. No. 4,772,878 shows a similar adhesive sensor with a rigid housing. It is adhered to an article to be protected with a plane side surface, in which a piston movable perpendicular thereto is integrated. Movement of the piston activates an electrical switch so that an alarm situation can be detected.

The disadvantage of these adhesive sensors is that they are difficult to secure permanently on curved surfaces of the articles to be protected and, in particular, false alarms occur again and again during normal use of the articles on display by the customers due to these sensors being inadequately secured to the article. This means that sales personnel in the store are constantly being confronted with a false alarm and so their attention to an alarm which has been set off will diminish and an actual alarm situation is no longer taken seriously.

With the ever increasing importance of an artistic design for the high-priced articles and equipment, it will be more and more difficult to find a flat surface on the article to be protected which is adequate for the conventional adhesive contacts and which will ensure a reliable and permanent proper contact between sensor and article.

A further disadvantage of all the known sensors is the fact that with these the sensor element monitors only a small part of the contact surface of the sensor to the article to be protected and so these sensors are not safe from manipulation. For example, a razor blade can be pushed between sensor and article and then the sensor lifted from the article with the razor blade without this being detected by the sensor element.

Moreover, the known adhesive contacts or adhesive sensors are relatively voluminous and so they cannot be attached, in particular, on the underside of articles displayed ready for use without the operability of the devices or their secure stance being partially impaired.

The object of the invention is to propose a monitoring sensor for universal use which can be produced in a flat type of construction and also connected without problem to curved or arcuate surfaces to form a proper and permanent contact and which is as far as possible safe from manipulation.

This object is accomplished in accordance with the invention, in a monitoring sensor having the features specified at the outset, in that the sensor comprises a flexible contact surface element which abuts areally on the article when there is a proper contact between sensor and article, and that the sensor element is designed and arranged such that any effect of a force on the contact surface element and/or any alteration in the shape of the contact surface element during disconnecting of the contact between sensor and article results in an alteration in the measured variable.

The inventive flexibility of the contact surface element allows an exact adaptation of the monitoring sensor to the surface of the article to be protected. This means that an adhesive contact between the sensor and the article to be protected over a large surface area can be provided and this is very durable and precludes false alarms. In particular, articles not having any plane outer surfaces can also be protected with the monitoring sensor since the sensor can be adapted to any optional outer contour.

In addition, it is possible to design the contact surface element and the sensor element to be very flat so that the overall constructional height of the monitoring sensor is very small. This opens up a large number of possibilities for attaching the sensor to the article to be protected which could not be utilized with the adhesive sensors previously known. Thus, the inventive monitoring sensor can be adhered to the underside of the articles to be protected in a large number of cases. This results in the advantage that the outward appearance of the article to be protected is not impaired.

Due to the fact that the sensor element detects any effect of a force on the contact surface element and/or any alteration in the shape of the contact surface element occurring, in particular, in edge regions, any manipulation of the sensor properly attached to the article to be protected and, therefore, any attempt to steal the article will be detected.

Electrical signals or measured values are particularly suitable as measured variable but optical or magnetic measured variables can also be used for monitoring a proper contact between sensor and article.

A particularly preferred embodiment is characterized by the fact that the contact surface element forms a flat side of the sensor and that the sensor element extends into edge regions of the contact surface element. This takes into account the fact that any separation of the sensor from an article to be protected starts at the edge of the sensor, whereby the flexible contact surface element which extends as far as the edge of the sensor is deformed to a particularly great extent in the edge region. This alteration in shape is detected by the sensor element particularly reliably when this extends right into edge regions of the contact surface element. This embodiment therefore results in the advantage that attempts to manipulate the sensor properly arranged on an article to be protected will be detected very reliably.

A particularly reliable detection of any alteration in the shape of the contact surface element, even if this takes place only in one part of the contact surface element, is additionally aided by the sensor element being designed to have a large surface and to be adapted essentially to the surface area extension of the contact surface element at least in one direction.

It is, however, also possible for the sensor element to be arranged essentially only in edge regions of the contact surface element. This again results in an extremely reliable detection of attempts to steal articles.

In addition, a second sensor element, such as a microswitch, can be associated with the contact surface element, for example, in the area of the center of the contact surface of the contact surface element for monitoring the proper contact with the article. This results in a particularly high degree of security with respect to attempts at manipulation. Such a measure can, of course, be appropriate for protecting very expensive articles.

A particularly reliable monitoring of the proper contact between sensor and article over the entire contact surface and, in addition, a low constructional height of the sensor are achieved when the sensor element is deformable with the contact surface element for adaptation to the shape of the article and is arranged to extend essentially parallel to the contact surface of the contact surface element.

The universal applicability of the sensor is aided by the fact that the sensor element is adaptable with the contact surface element to the shape of the article. For this purpose, the sensor element is also preferably designed to be flexible so that it is possible to realize an altogether very flexible sensor, especially with a considerable, surface area extension of the sensor element, so that the contact surface of the contact surface element is adaptable in an optimum manner to any shape or surface of an article to be protected.

The arrangement of the sensor element parallel to the contact surface of the contact surface element allows a particularly flat design and, therefore, a great flexibility of the sensor.

The sensor element is preferably arranged directly on the contact surface element or even embedded at least partially in this element. This results in a direct transfer to the sensor element of every alteration in shape or force effect which the contact surface element experiences. Consequently, a particularly reliable detection of attempts at theft is made possible.

In an alternative development, the sensor element can have a very compact shape in comparison with the areal design of the contact surface element.

A rubber-elastic material is preferably used for the production of the flexible contact surface element and this allows a particularly good adaptability of the contact surface element to curved or arcuate surfaces of the article to be protected. A soft rubber material is particularly suitable for this purpose but plastic materials can also be used.

It has proven to be advantageous for the housing material to have a Shore hardness of 20 to 50 and, in particular, of 25 to 40. This means that the sensor has a good flexibility with a sufficient protection of the components, such as the sensor element, arranged in the housing.

A particularly preferred embodiment is characterized by the fact that the sensor has a flexible housing and that the contact surface element is designed in one piece with the housing. This results in a particularly simple production, in which, for example, the sensor element together with necessary connection parts and the beginning of the connecting cable are incorporated in the housing. Alternatively, the housing can, however, also be designed in several parts.

In any case, the housing is preferably of a very flat construction so that not only a low constructional height but also a great flexibility of the sensor are ensured. In addition, the flat design leads to a generous dimensioning of the contact surface of the contact surface element when the contact surface is formed by a flat side of the housing so that a particularly secure connection with the article to be protected is made possible.

The contact surface element preferably comprises an adhesive layer for attachment of the sensor to the article. In this respect, the adhesive layer forms a generously dimensioned adhesive surface, by means of which the contact surface element can be secured directly on the article to be protected. In this case, the entire surface facing towards the article to be protected is preferably used for the adhesive contact in order to provide a particularly durable and permanent connection of the sensor with the article. This results in an improved connection in comparison with the state of the art since an adhesive surface of the adhesive layer which corresponds to the entire contact surface of the contact surface element can be used for attachment and recesses for actuating elements of switches or the like, as provided in the state of the art, are not necessary.

Furthermore, the adhesive layer provided enables the monitoring sensor to be attached to the article to be protected in a very simple manner without separate attachment means being required. Alternatively, the sensor can, however, also be attached to the article with the aid of an adhesive material or a separate adhesive element.

A first, particularly preferred design alternative is characterized by the fact that the sensor element is arranged between the adhesive layer and the contact surface element. In this respect, the sensor element is completely enclosed, in particular, by the adhesive layer and the contact surface element so that these form a sheathing protecting the sensor element. This means that a housing for accommodating the sensor element can be omitted and a particularly low constructional design of the sensor is possible. Consequently, a very simple and inexpensive production of the sensor results.

In an advantageous development, it is also provided for the adhesive layer to adhere more strongly to the article than to the contact surface element and for the sensor element to adhere to the adhesive layer so that during disconnecting of the proper contact between sensor and article the sensor element is separated at least partially with the adhesive layer from the contact surface element and as a result a measuring loop formed by the sensor element is interrupted. Due to the varying adhesive properties or varying adhesive forces which are very simple to realize, the sensor element will be destroyed when an attempt is made to detach the sensor from an article to be protected in that the sensor element remains on the article at least partially, like the adhesive layer as well. Due to this force effect, a measuring loop formed by the sensor element is interrupted and so it is very easy to detect when a proper contact of the sensor with the article is disconnected.

A second, alternative design variation results when the adhesive layer adheres more strongly to the article than to the contact surface element and the sensor element is integrated into the adhesive layer such that during disconnecting of the proper contact between sensor and article the sensor element is separated at least partially with the adhesive layer from the contact surface element and as a result a measuring loop formed by the sensor element is interrupted. This again leads to destruction of the sensor element when the sensor is detached from the article. Due to the interruption of the measuring loop formed by the sensor element, a very simple and reliable detection of the attempt at theft again results. One advantage of this variation is to be seen in the fact that it must merely be ensured that the adhesive layer adheres to the article better than to the contact surface element and, otherwise, any adhesion forces possibly occurring between the sensor element and the contact surface element are irrelevant. Consequently, this embodiment is very reliable in operation. A simple production is made possible, for example, by the fact that the sensor element is embedded between two superimposed layers of adhesive material.

A particularly simple way to realize the measuring loop formed by the sensor element is characterized by the fact that the sensor element comprises an electrical conductor loop, in particular, in the form of a metal foil. An electrical conductor loop has the advantage that any interruption of the circuit formed by the conductor loop can be detected with very little effort. The design of the conductor loop, in particular, as a metal foil leads not only to an inexpensive production but also to a particularly flat mode of construction for the sensor element. Moreover, the conductor loop abuts areally on the adhesive layer and, consequently, the conductor loop has a good adhesive connection with the adhesive layer so that if the sensor becomes detached from the article to the protected it is ensured that the conductor loop will adhere to the adhesive layer separating from the contact surface element. In the case of any manipulation, this leads to an intended destruction of the conductor loop and therefore to a reliable detection of the attempt at theft.

Further advantages of the thin, foil-like design of the sensor element are to be seen in the fact that the sensor element is very flexible and so a great flexibility of the entire sensor can be attained and that a foil is already destroyed with a slight force effect when the adhesive layer becomes detached from the sensor and so a particularly reliable detection of attempts at theft results.

Alternatively to the foil-like design of the conductor loop, this can also be formed by a vapor-deposited metal layer or a very thin wire. In addition, rupture points can be provided in order to ensure an intended interruption of the conductor loop when the sensor becomes detached from the adhesive layer.

A particularly simple contacting of the conductor loop is attained when at least two contact points are integrated into the contact surface element. This provides for a very simple production in that, for example, the conductor loop and the adhesive layer are applied to the contact surface element one after the other, the electrical contact to the conductor loop being ensured by abutment on the contact points. However, contacting via connection wires can also be used.

A further, preferred design variation is characterized by the fact that the sensor element comprises a strain gauge. This results in a very sensitive detection of each alteration in the shape of the contact surface element since the strain gauge clearly varies its electrical resistance at the slightest alterations in shape or force effects. In addition, the strain gauge is very flat and therefore facilitates a low constructional height of the sensor.

A preferred development results when the strain gauge is integrated at least partially into the flexible contact surface element. In this way, each alteration in the shape of the contact surface element when the sensor becomes detached from the article to be protected is transferred particularly reliably to the strain gauge and registered. However, the strain gauge can, for example, also be adhered to a flat side of the contact surface element.

An additional design variation is characterized by the fact that the sensor element comprises a flexible light transfer element with an associated light emitter and light receiver. This design variation is based on the idea that the shape of the light transfer element alters with any alteration in the shape of the contact surface element, and the light transfer properties of the light transfer element are influenced thereby. Accordingly, the light signal received by the light receiver is dependent on the shape of the contact surface element. This means that alterations in the shape of the contact surface element are reflected in an alteration of a measured variable emitted by the light receiver. This design variation is not limited to the use of light or, more generally speaking, electromagnetic waves but it is also conceivable for, for example, ultrasonic waves to be used, whereby emitter, receiver and transfer element are each adapted accordingly.

In any case, the last-mentioned design variation makes a highly sensitive detection of alterations in the shape of the contact surface element possible and, with it, a very reliable detection of attempts at theft.

The light emitter is preferably designed as a gallium arsenide diode and the light receiver as a phototransistor. These components are inexpensive to buy and accordingly make an inexpensive production of the monitoring sensor possible. In addition, these components function very reliably and are robust so that the resulting monitoring sensor is very reliable in operation.

It has proven to be advantageous for the light emitter to be controllable such that it regularly emits light signals, in particular with a frequency of 5 to 50 Hz. In this respect, the frequency is selected such that a sufficiently quick detection of alterations in the shape of the light transfer element and, with it, of the contact surface element, as well, is ensured. By emitting flashes of light instead of having a continuous operation of the light emitter, a considerable saving in energy can be achieved and this makes itself clearly noticeable when a plurality of monitoring sensors are used.

It is preferable for the light transfer element to be arranged such that the main direction of transfer of the light extends essentially parallel to the contact surface of the contact surface element. This means that attempts to manipulate the contact surface element, which mostly result in a movement of the contact surface element transversely to its contact surface, influence the light transmission in-the light transfer element particularly clearly and, with it, the measured variable supplied by the light receiver. This results in a very reliable detection of attempts at manipulation. Alternatively, the light transfer element can, for example, be arranged to extend perpendicular to the contact surface.

A particularly preferred development is characterized by the fact that the light transfer element comprises a tubular conductor which is designed in one piece with the contact surface element and forms at least one light channel from the light emitter to the light receiver. Such an integral design results not only in a simple production but also in a direct coupling of the light transfer element with the contact surface element and so any alteration in the shape of the contact surface element is transferred directly to the light transfer element. This means that alterations in the shape of the contact surface element can be detected particularly reliably by the sensor element.

In this respect, it is preferable for the wall of the light channel to be not or only slightly reflecting. The contact surface element and, where applicable, the entire housing of the monitoring sensor are, for example, manufactured from a dull-black material. Consequently, the light intensity detected by the light receiver as measured variable of the sensor element is directly dependent on the cross section of the direct, straight line-of-sight connection between light emitter and light receiver. Alterations in the shape of the contact surface element lead to alterations in the side walls of the light channel formed by the contact surface element and, therefore, to an alteration in the measured variable supplied by the light receiver. Consequently, this results in a simple and reliable detection of alterations in the shape of the contact surface element.

Alternatively, the light transfer element can, for example, also be limited by reflecting walls. In this case, when alterations in the shape occur these result, for example, in influences on the phase position or the distribution of intensity which are detected by the light receiver or a corresponding detector element.

Furthermore, it is provided for the light channel to be arranged at least partially in a section of the housing having a reduced cross section. This brings about a particularly great flexibility of the sensor in at least one region of the light channel. Consequently, every attempt to disconnect the contact between monitoring sensor and article leads to the sensor and, with it, the light channel being deformed particularly easily in the region of the section having a reduced cross section. This results in a particularly sensitive detection of attempts at manipulation.

The inventive monitoring sensors can, in addition, be equipped with an optical display for the operating state and the functioning of the sensor. In this respect, the light-emitting diodes which are of a very small construction are particularly suitable.

The optical display is preferably operated in the function, in which it indicates a manipulation at the connection of article and monitoring sensor permanently, i.e. until the alarm is turned off by authorized personnel. In the case of an alarm, this makes it easier for the sales personnel to find the article which was intended to be stolen. Where necessary, a proper contact between article and sensor can also be established again very quickly.

Alternatively or additionally, the optical display is operated such that it emits an optical signal, such as a flashing signal, when the sensor is properly attached to the article to be protected in order to draw the attention of potential thieves to the theft monitoring and to deter them from stealing the article. In this respect, the optical display can also be formed by the light emitter provided for the sensor element in one design variation and the flashing of this light emitter is visible in the activated state of the sensor through a region of the sensor housing which is accordingly designed to be light-transmissive.

Moreover, the optical display can, of course, also be used to convey other information, such as, for example, for the optical indication for a new and correct connection of the sensor with the monitoring circuit. For this purpose, a short lighting up of the display can, for example, be sufficient.

In addition, it is also possible to switch over between different display modes of the optical display. Such a switching over is preferably controlled centrally by the theft protection system.

A particularly reliable protection against false alarms is achieved when the sensor comprises a rigid connecting part for the connection cable. In this case, forces acting on the connecting cable in the direction towards the flexible contact surface element are neutralized to a great extent so that no or only minimal forces are exerted on the sensor element due to movement of the connecting cable, for example when a customer is inspecting the article to be protected. The cable connection area, the rigid connecting part and the flexible contact surface element can, of course, be designed with a one-piece sheathing.

In cases, in which the inventive monitoring sensor is used with a novel monitoring circuit for theft protection systems, which will be described later on, the measured variable supplied by the sensor element can be made directly available to the monitoring circuit without processing and conversion. Any processing and evaluation of the measured variable then takes place within the monitoring circuit of the theft protection system.

However, in order to be able to use the monitoring sensor with conventional theft protection systems, as well, a circuit can be integrated into the sensor and this circuit processes the measured variable supplied by the sensor element, in particular the strain gauge or light receiver, for the monitoring circuit. The object of this circuit integrated into the sensor is to provide an output signal which can be utilized by a conventional theft protection system, whereby a digital signal can, for example, be made available.

Accordingly, a preferred development is characterized by the fact that the circuit comprises an evaluation circuit for processing the measured variable of the sensor element and converting it into a digital value as well as a storage means for the intermediate storage of the digital value, whereby the circuit processes the measured variable at predetermined time intervals and converts this into a digital value and transmits a signal indicating an alarm to the monitoring circuit when the digital value intermediately stored differs from a later digital value by a predeterminable value. Thus, the monitoring sensor is particularly adaptable in its use, i.e. irrespective of the design of the flexible contact surface element and, therefore, regardless of an initial value of the measured variable supplied by the sensor element, which is dependent on the shape of an article to be protected. In this respect, when the sensor is connected to the monitoring circuit for the first time the measured variable, for example the resistance value of the strain gauge or the measured variable supplied by the light receiver, is processed and stored and in the case of a later, relevant alteration in the measured variable a separate output signal is made available for the monitoring circuit. The monitoring circuit recognizes an alarm situation on the basis of this signal. Instead of integrating the evaluation circuit into the sensor itself, the circuit can, of course, also be installed in a plug contact, with which the connecting cable of the sensor can be connected to the theft protection system.

It is also conceivable for a connection of a conventional theft protection system to be provided with an interface which makes it possible to connect a monitoring sensor without a processing circuit for the measured variable of the sensor element.

The invention also relates to a novel monitoring circuit for a theft protection system which is designed especially for use with a monitoring sensor of the present invention in that this monitoring circuit comprises an evaluation circuit for processing the measured variable of the sensor element and converting it into a digital value as well as a storage means for the intermediate storage of this digital value. In this respect, the monitoring circuit will process the measured variable supplied by the sensor element at predetermined intervals and convert it into a digital value and trigger an alarm when the digital value intermediately stored differs from a digital value obtained at a later time by a predetermined value. In the simplest case, it is sufficient to store a one-figure digital value.

The advantage of using the digital filter formed in this manner for triggering the alarm is that minimal alterations in the measured variable of the sensor element, such as those caused, for example, by rough handling of the article protected with the inventive monitoring sensor, are not taken into consideration when triggering an alarm and so an alarm is actually triggered only in the case of a serious manipulation of the contact between monitoring sensor and article. Furthermore, it is possible for the predetermined value to be adjusted by the operating personnel so that the system is adaptable in its sensitivity to the respective instance of use.

In addition, the specified evaluation circuit has the advantage that sensors having different sensor elements, which supply, for example, very different, electrical resistance values as measured variables, can all be connected to the same type of monitoring circuit.

Furthermore, the invention relates to a theft protection system having a monitoring circuit as described above. Such a theft protection system can operate with monitoring sensors of an extremely small construction and manages essentially with one single type of monitoring sensor since the inventive monitoring sensors satisfactorily operate together with practically every article to be protected and can be attached thereto without impeding the operability of the article.

In general, the monitoring sensors are intended to be attached to articles having firm surfaces. However, the monitoring sensors, the sensor element of which indicates a distinct alteration in the measured variable only when the sensor is detached from a protected article, as is, for example, the case in the embodiment with the conductor loop arranged between contact surface element and adhesive layer, also enable articles having pliable surfaces to be protected.

Moreover, the inventive monitoring sensors do not, in any way, spoil the appearance of the article to be protected since they can be designed to be very unobtrusive and can, therefore, also be used in cases where a particularly demanding presentation of the article from an optical point of view is of importance.

In a particularly preferred embodiment of the inventive theft protection system, this protection system comprises an activation circuit which activates the monitoring circuit allocated to a connection when the connection is occupied for the first time with a connecting cable of a monitoring sensor, whereby at a predetermined time interval in relation to the activation this monitoring circuit processes the measured variable of the sensor for the first time and stores it intermediately in the storage means.

With the automatic activation of the monitoring circuit when a connection of the theft protection system is occupied for the first time, blind plugs for the connections not in use can be dispensed with and this is of great advantage for the handling of the theft protection system. In addition, the predetermined time interval in relation to the activation, in which the measured variable of the sensor is processed, converted and intermediately stored in the storage means, can be selected such that a reliable attachment of the sensor to the article is possible and, therefore, a constant measured variable of the sensor in its state properly connected to the article is achieved before a digital value is stored.

The operating personnel can also be given a certain scope with the predetermined time interval so that in cases where the sensor is regularly attached to the article before the connecting cable is connected to the theft protection system a relatively short time interval can be selected. On the other hand, in the cases where, due to inexperienced personnel, the connecting cable is often connected to the monitoring circuit before the actual sensor is properly connected to the article, the triggering of a false alarm can be avoided by selecting a correspondingly longer time interval for the evaluation of the first digital value by the evaluation circuit.

In the following, the invention will be explained in greater detail on the basis of drawings showing three embodiments. In the drawings.

Figure 1:
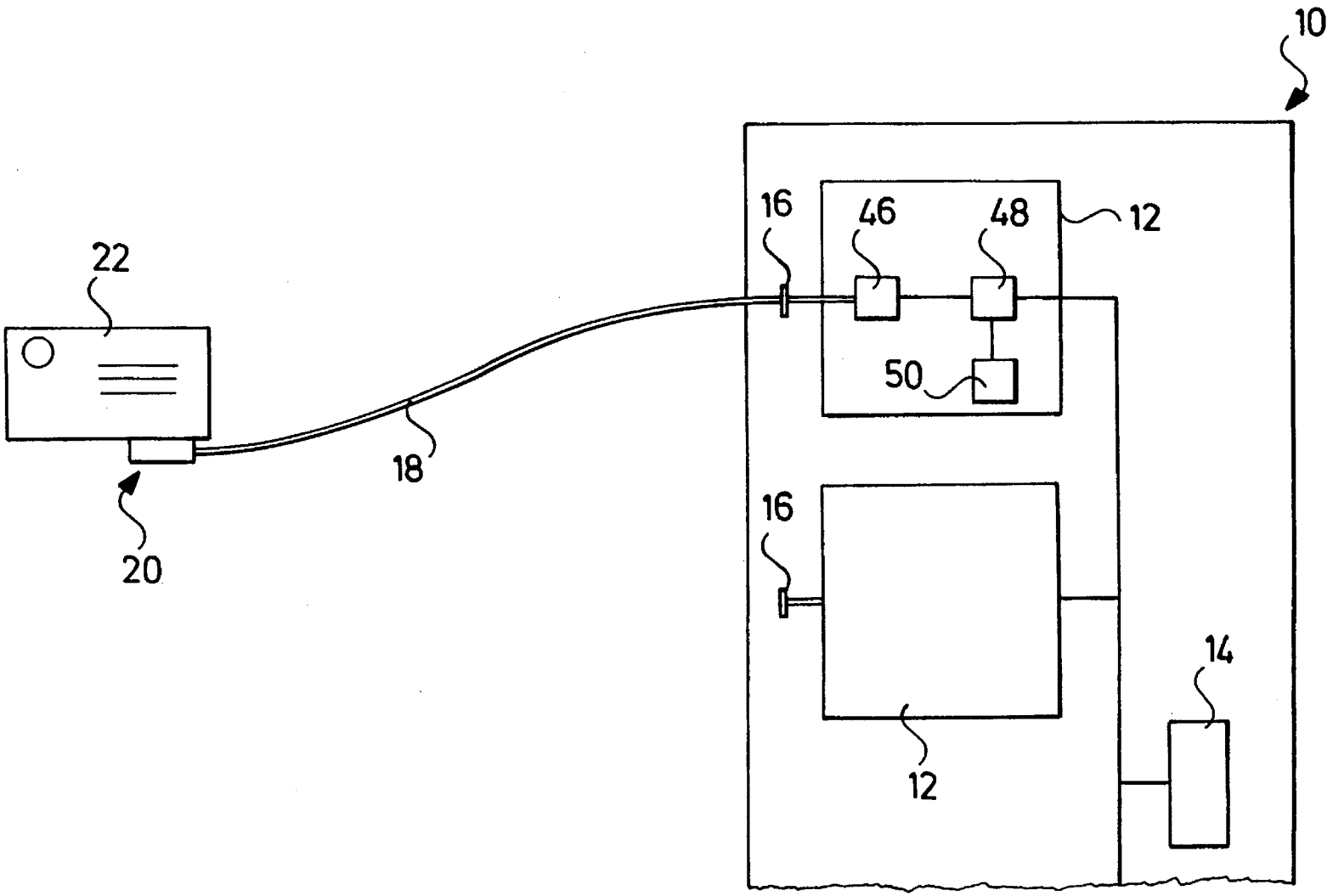
FIG. 1 is a schematic illustration of an inventive theft protection system.

FIG. 1 shows an inventive theft protection system 10 which has at least one, but preferably a plurality of monitoring circuits 12 as well as a common alarm device 14.

A monitoring sensor 20 can be connected to each monitoring circuit 12 via a plug connection 16 and a connecting cable 18.

In the illustration according to FIG. 1, one sensor 20 is connected with the monitoring circuit 12 via the connecting cable 18 and, in addition, attached to an article 22 to be protected.

When a thief attempts to manipulate the sensor 20 or the connecting cable 18, this is detected by the associated monitoring circuit 12 and a signal transmitted to the alarm device 14 of the theft protection system 10. The alarm device 14 then indicates the alarm, for example, by means of an acoustic signal or an optical display.

Figure 2:
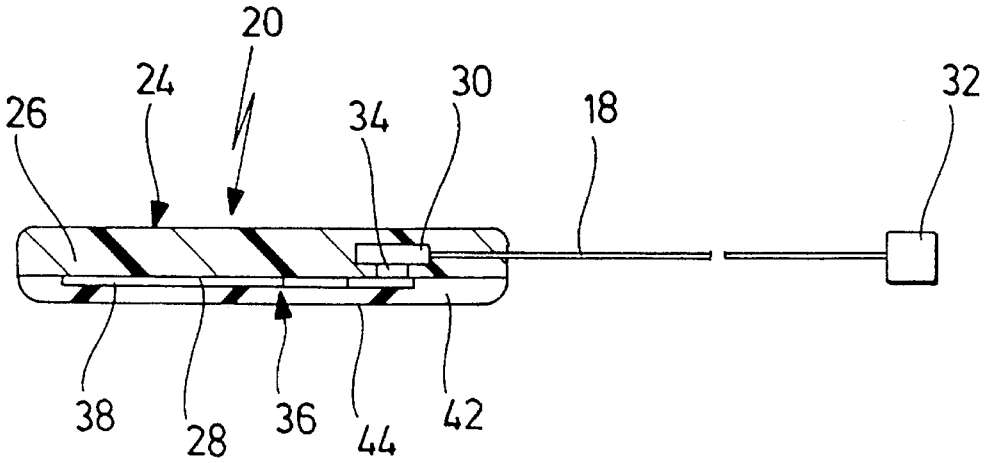
FIG. 2 is a sectional view of a first embodiment of an inventive monitoring sensor.

FIG. 2 shows a first embodiment of an inventive sensor 20. This has a flexible, very flat housing 24 made of a rubber-elastic material. The housing 24 has an integrated contact surface element 26 with a flexible, smooth contact surface 28 which forms a flat side of the housing 24.

In the illustrated embodiment, the housing 24 is essentially designed as a flat rectangular parallelepiped with rounded edges. The contact surface 28 corresponds to a surface area of the parallelepiped. However, the housing 24 can also have the shape of a flat section of a circular cylinder or of an elliptical cylinder or any other shape. It is important that a flexible contact surface element 26 is formed.

A rigid connecting part 30, to which the connecting cable 18 is connected, is embedded in the housing 24. The connecting part serves to provide, on the one hand, a rigid mechanical connection of the connecting cable 18 with the sensor 20 as strain relief and, on the other hand, an electrical connection of the sensor 20 to the connecting cable 18. Since the connecting part 30 is completely encased by the housing 24, the connecting cable 18 is also partially embedded in the housing and thus mechanically connected therewith.

At its free end, the connecting cable 18 has a schematically indicated plug 32 for forming the plug connection 16 and for connecting the sensor 20 to a monitoring circuit 12 in the theft protection system 10.

The connecting part 30 is of a very flat design and extends with its main plane of extension essentially parallel to the contact surface 28. The connecting part 30 has two contact points 34 in the form of contact pins which each extend through the contact surface element 26 as far as the contact surface 28 and, where applicable, are raised somewhat above the contact surface 28.

The contact points 34 serve to provide an electrical connection of a sensor element 36 arranged on the contact surface 28. The sensor element 36 is arranged to extend parallel to the flat contact surface element 26 and in the embodiment shown in FIG. 2 lies flat on the contact surface 28.

Figure 3:
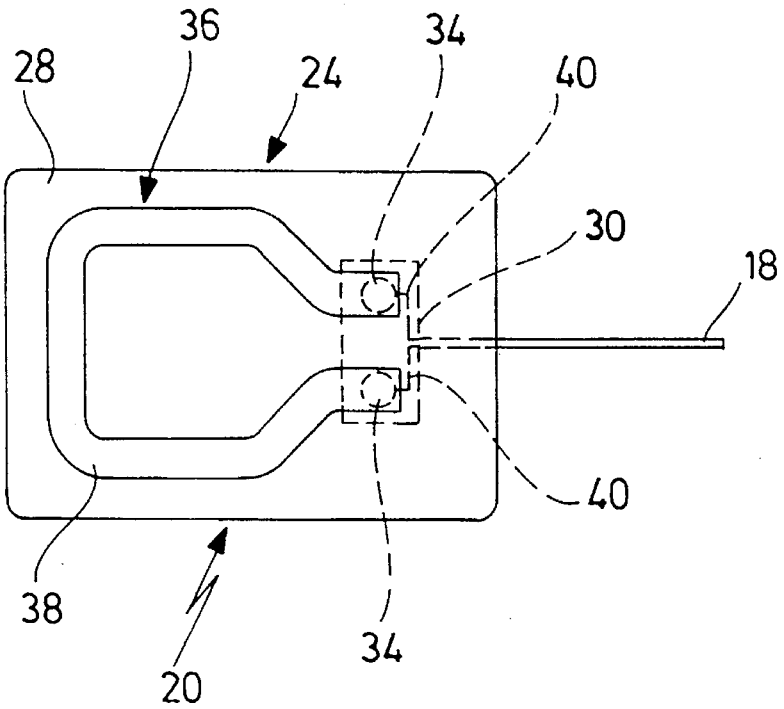
FIG. 3 is a view of the sensor according to FIG. 2 from underneath.

As can be seen in FIG. 3, the sensor element 36 of the first embodiment of the sensor 20 is formed by a conductor loop 38 lying on the contact surface 28. In this case, the conductor loop 38 is formed by a strip of metal foil made from aluminum which is arranged in spaced relation and extending approximately parallel to the edge of the contact surface 28 of the contact surface element 26. In the embodiment shown in FIG. 3, the conductor loop 38 essentially forms an open U and covers one of the contact points 34 of the connecting part 30 with the free end of each of its arms.

As the conductor loop 38 rests on the contact points 34, an electrical contacting of the conductor loop 38 results. In order to ensure a good contact between the contact points 34 and the conductor loop 38, the contact points 34 are preferably designed to be slightly raised in relation to the contact surface 28. In addition, the surfaces of the contact points 34 are preferably coated with gold in order to ensure a low contact resistance to the conductor loop 38.

Alternatively, the conductor loop 38 is formed by a metal web, e.g. of silver, vapor-deposited accordingly and this can also be vapor-deposited onto the contact points 34 to provide the electrical contact. With a resilient design of the contact points 34, the conductor loop 38 or the measuring loop can be attached to the adhesive layer 42.

It is to be noted that the measuring loop or conductor loop 38 is preferably attached to the side of the adhesive layer 42 facing the contact surface 28 prior to the adhesive layer 42 being attached to the contact surface element 26 in order to ensure a good bonding between the measuring loop and the adhesive layer 42.

It is indicated in FIG. 3 that a connecting line 40 leads from the connecting cable 18 to each of the contact points 34 so that a closed circuit can be formed through the conductor loop 38 and via the contact points 34, the connecting lines 40 and the connecting cable 18 for the monitoring circuit 12.

FIG. 2 shows that the sensor element 36 is completely covered with an adhesive layer 42 on the contact surface 28 of the contact surface element 26. This adheres both to the contact surface 28 and to the sensor element 36. For reasons of illustration, the representation of this adhesive layer 42 has been omitted in FIG. 3.

The adhesive layer 42 is formed by a double-sided adhesive tape which is covered on its adhesive surface 44 facing away from the the contact surface element 26 by a protective foil, which is not illustrated, until it is attached to the article 22 to be protected.

In the borderline case, the housing 24 is of such a flat design that it is identical to the contact surface element 26. The electrical connection of the sensor element 36 can then be brought about by the connecting cable 18 being adhesively secured in place between the contact surface element 26 and the adhesive layer 42 or solely in the latter and connected to the sensor element 36. This allows an extremely thin sensor 20 of only a few millimeters to be realized.

In the following, the connection of the sensor 20 to the theft protection system 10 and the functioning of the article protection will be described.

The sensor 20 is secured to a surface of the article 22 with its contact surface element 26 facing the article 22, whereby this is achieved with the aid of the adhesive surface 44 of the adhesive layer 42 which has been freed from the protective foil which is not illustrated. Due to the flexible design of both the sensor element 36 and the contact surface element 26, including the housing 24, the sensor 20 can be adapted to any optionally rounded or curved surface of the article 22. In order to provide the proper contact between sensor 20 and article 22, the sensor 20 is bonded to a surface, preferably the underside, of the article 22 with the adhesive surface 44 over the entire surface area. In this respect, the essentially parallel arrangement of the sensor element 36 in relation to the contact surface element 26 is maintained even with a curvature of the sensor 20.

Once the sensor 20 has been fitted to the article 22 to be protected, the sensor 20 is connected to the theft protection system 10 via the connecting cable 18 in that the plug 32 is plugged into a plug connection 16 and thus the connection provided to an associated monitoring circuit 12.

The first connection of the sensor 20 to the monitoring circuit 12 is detected by an activation circuit 46 of the monitoring circuit 12. This activates the following evaluation circuit 48 with a predetermined or adjustable delay time. This means that following the delay time the evaluation circuit 48 monitors the sensor 20 connected via the plug connection 16 and the connecting cable 18 with a view to a proper contact with the article 22 as well as the electrical connection to the sensor 20 with respect to other attempts at manipulation. For this purpose, a current flowing through the sensor element 36 of the sensor 20 or the electrical resistance formed by the sensor element 36 is, for example, evaluated by the evaluation circuit 48 as measured variable. This circuit converts the measured variable into a digital value which is intermediately stored in a storage means 50 following the activation by the activation circuit 46. Subsequently, the measured variable is regularly measured and converted by the evaluation circuit 48, whereby an actual measured value is always compared with the stored value. When a difference is ascertained, which exceeds a predetermined amount, an alarm situation is present and a corresponding signal is transmitted to the alarm device 14.

When the sensor 20 is detached from the article 22 during an attempt to steal it, the adhesive layer 42 remains adhered to the article 22 with the sensor element 36 or the conductor loop 38. It is, at the most, possible to remove the contact surface element 26 from the adhesive layer 42. For this purpose, the adhesive layer 42 has a higher adhesive or bonding force at the adhesive surface 44 than in relation to the contact surface element 26. Consequently, when the sensor 20 is removed from the article 22 the measuring loop formed by the sensor element 36, such as the electrical conductor loop 38, is interrupted. Where necessary, the measuring loop can have, in addition, rupture points, such as narrowed sections or perforations, for the defined interruption. This destruction of the sensor 20 in the case of a manipulation represents a very essential characteristic of this inventive embodiment which ensures a particularly reliable detection of attempts at theft.

The interruption leads to a distinct change in the measured variable which is recognized by the evaluation circuit 48 as an alarm situation. In this case, the evaluation circuit 48 transmits a signal triggering an alarm to the alarm device 14.

Furthermore, the evaluation circuit 48 also recognizes alterations in the measured variable which are attributable to manipulations of the connecting cable 18 or the plug connection 16, such as a short circuit or separation of the connection, accordingly and an alarm is triggered.

The evaluation process described represents a preferred process variation. However, a different evaluation, for example with the use of solely analogous measured values, is also possible. There is also the possibility of regularly resetting the initial value stored in the storage means 50 to the actual measured value by a renewed storage when the measured variable is altered within the allowed tolerance range. Hence, slow changes in the measured value, such as those caused, for example, by the influence of temperature, can be taken into consideration without a false alarm being triggered.

In the case of the sensor 20 according to the first embodiment described, the contact points 34 can alternatively be formed by contact springs. These are arranged and held, for example, by the contact surface element 26 or the connecting part 30 such that a section of the spring, such as a free end, protrudes each time beyond the contact surface in the non-loaded state. The abutting electrical conductor loop 38 is then electrically contacted in a particularly reliable manner via the contact springs due to the spring force, even when the conductor loop 38 is at a slight distance from the contact surface 28, for example due to production tolerances.

In addition, the measuring loop or the conductor loop 38 can form one or more electrical connections, which can also be in a straight line, on the contact surface 28 or on the adhesive layer 42 and these are interrupted at least partially when the sensor 20 is removed from an article 22 to be protected due to the adhesive layer 42 becoming detached from the contact surface element 26. The intended interruption of the electrical connection can also be accelerated by the conductor loop 38 having, particularly with a foil-like design, cuts, notches or perforations which facilitate tearing.

An essential idea of the invention is also to be seen in the fact that the adhesive layer 42 can already be precut or perforated, in particular with the measuring loop, such that the adhesive layer 42 is torn when the sensor 20 is withdrawn from an article 22 to be protected so that sections of the adhesive layer 42, which also bear sections of the measuring loop, remain on the article 22 to be protected. This results in a particularly reliable interruption of the measuring loop and a correspondingly reliable detection of manipulations of the sensor 20.

In the following, a second and a third embodiment of the inventive monitoring sensor will be described in greater detail. In this respect, parts which are the same or have the same effect are, in principle, designated with the same reference numerals as in the above even if they are not expressly mentioned. Furthermore, the additional embodiments of the monitoring sensor generally result in the same handling, the same application and the same advantages as the first embodiment.

Figure 4:
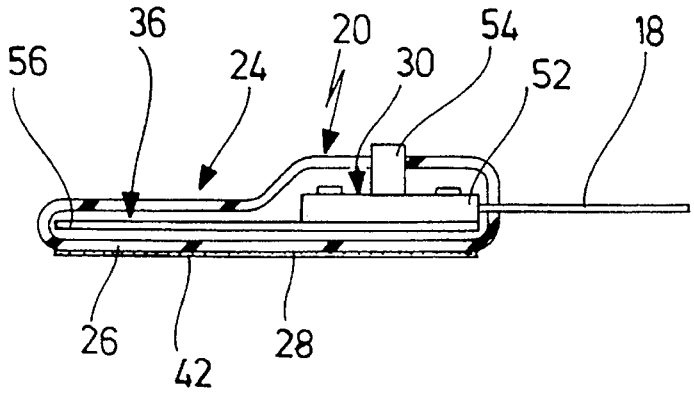
FIG. 4 is a sectional view of a second embodiment of an inventive monitoring sensor.

The inventive monitoring sensor 20 according to the second embodiment in FIG. 4 again has a housing 24 which is produced from a rubber-elastic material and forms an integrated, flexible contact surface element 26. The housing 24 is essentially of a flat design, whereby the contact surface element 26 forms an essentially plane contact surface 28 in the state, in which the sensor 20 is not attached to an article 22.

A sensor element 36 is arranged in the housing 24 to extend essentially parallel to the contact surface element 26. The sensor element 36 is again connected to the connecting cable 18 of the sensor 20 via a rigid connecting part 30 in the interior of the housing 24.

A circuit 52 is integrated into the rigid connecting part 30; this circuit will be described in greater detail later on. Furthermore, an optical display 54 is arranged on the connecting part 30 in the form of a light-emitting diode which penetrates the housing 24 on the side of the sensor 20 facing away from the contact surface element 26 and is visible.

An adhesive layer 42 is again arranged on the contact surface 28 of the contact surface element 26 and serves to attach the sensor 20 to the article 22 to be protected.

In the second embodiment, the sensor element 36 is designed as a strain gauge 56. This preferably rests directly on the side of the contact surface element 26 facing away from the contact surface 28, whereby in the illustration according to FIG. 4 a certain distance is present between the strain gauge 56 and the contact surface element 26 for reasons of clarity. Due to this arrangement of the sensor element 36 in relation to the contact surface element 26, every alteration in the shape of the flexible contact surface element 26 will lead to an alteration in the shape of or a force acting on the sensor element 36 formed by the strain gauge 56. This leads accordingly to an alteration in a measured variable which, in this case, is formed, in particular, by the electrical resistance or a current flowing through.

The sensor 20 according to the second embodiment is also attached to an article 22 for its protection in that the proper contact between sensor 20 and article 22 is provided by the sensor 20 being adhered with its adhesive layer 42 to a surface of the article 22 over the entire surface area and thus securely connected to this article. Due to the flexible design of the sensor 20, the contact surface element 26 can be adapted to any optional curvature of the surface of the article 22 so that the attachment of the sensor 20 to the article 22 can be subjected to a high load and is therefore reliable.

The sensor 20 is then connected to a monitoring circuit 12 of the theft protection system 10 via the connecting cable 18.

An alternative to the first embodiment results for the processing and evaluation of the measured variable due to the circuit 52 which is integrated into the sensor 20 and, in the second embodiment, is arranged in the rigid connection part 30. This alternative signal evaluation is described in the following for the second embodiment of the sensor 20 but can, however, easily be utilized in the other embodiments of the sensor 20, just as, in the reverse case, the type of signal processing and alarm recognition of the first embodiment can also be used in the second and third embodiments.

Figure 5:
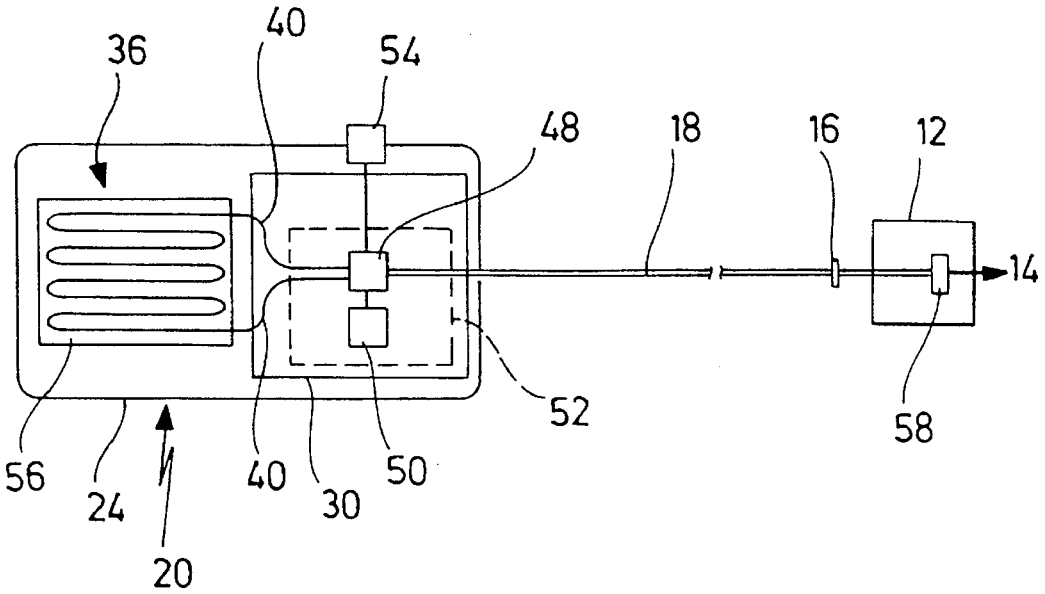
FIG. 5 is a schematic illustration of a circuit integrated into the sensor according to FIG. 4 with a connected connecting cable and a connected strain gauge.

FIG. 5 is a schematic representation of the electrical layout and connection of the sensor 20 according to the second embodiment to a monitoring circuit 12. The sensor element 36 formed by the strain gauge 56 is connected via connection lines 40 to the circuit 52 in the rigid connecting part 30. These components are all arranged in the flexible housing 24 of the sensor 20, preferably even embedded therein.

Current is supplied to the circuit 52 by the monitoring circuit 12 in the theft protection system 10 which is connected via the connecting cable 18 and the plug connection 16.

The circuit 52 has an evaluation circuit 48 with an associated storage means 50 which perform the same functions as in the process variation described on the basis of FIG. 1. Accordingly, the evaluation circuit 48 processes a measured variable of the sensor element 36, for which the electrical resistance or a current flowing through the strain gauge 56 are particularly suitable, such that manipulations of the sensor 20, in particular an alteration in the shape of the contact surface element 26 when the sensor 20 is detached from the article 22 to be protected, are detected. For this purpose, the evaluation circuit 48 converts the measured variable into a digital value which is intermediately stored in the associated storage means 50. Subsequently, the measured variable is regularly measured and converted into a digital value which is compared with the digital value intermediately stored. When a difference exceeding a predetermined amount is ascertained, the evaluation circuit 48 sends a signal designating an alarm situation. This signal is transmitted to the monitoring circuit 12 via the connecting cable 18 and the plug connection 16.

The monitoring circuit 12 has a detector circuit 58 which receives the output signal from the evaluation circuit 48 and recognizes an alarm situation. In the case of an alarm situation, the detector circuit 58 passes an alarm signal to the alarm device 14 to trigger the alarm. In addition, the detector circuit 58 can monitor the electrical connection to the circuit 52 in the sensor 20 and in the case of any manipulations, such as a short circuit or interruption of the connection, pass an alarm signal to the alarm device 14.

It is self-evident that in this alternative design variation described according to FIG. 5 an activation circuit 46 can also be arranged in the monitoring circuit 12 and this activation circuit causes an automatic activation once the plug connection 16 to a sensor 20 has been established. In this respect, this activation circuit 46 can, for example, not switch on the electrical supply to the circuit 52 until after a preselectable delay time so that until then it is possible for the sensor 20 to be attached to the article 22 to be protected, with a resulting alteration in the measuring variable of the sensor element 36, without a false alarm being triggered.

The display 54 connected to the circuit 52 is switched on for a short time when the connection of the sensor 20 to the monitoring circuit 12 is in order and the monitoring circuit 12 is in the activated state. During normal operation, the display 54 remains switched off. If the proper contact between article 22 and sensor 20 is lost even for a short time, the display 54 is permanently activated and emits, for example, a flashing signal until the monitoring circuit 12 is reset by authorized personnel and the alarm situation is therefore terminated.

It is also possible for the optical display 54 to blink regularly on the article 22 in the activated state in order to deter potential thieves.

The integrated circuit 52 can, as described above, check the measured variable of the sensor element 36 itself with a view to any change and indicate to the monitoring circuit 12 whether the monitoring sensor 20 detects the normal state of a proper contact between sensor 20 and article 22 or whether a situation is given, in which the proper contact between sensor 20 and article 22 is or has been disconnected. However, the circuit 52 can also make a digital value available to the monitoring circuit 12 which reflects the actual measured variable of the sensor element 36.

The connecting cable 18 can generally be molded onto the housing 24, be connected with the housing 24 by a strain relief, such as the connecting part 30, or in exceptional cases be connectable to the housing by a plug connection.

Furthermore, the connecting cable 18 can be of a two-wire, three-wire or also multiwire design, depending on the scope of the functions which are to be realized in the monitoring sensor 20 itself. In order merely to tap the measured variable of the sensor element 36 a two-wire connecting cable 18 is adequate. This can also be adequate when the integrated circuit 52 takes over the complete evaluation of the measured variable made available by the sensor element 36 and makes available for the monitoring circuit 12 a signal representing the proper contact and a signal representing the disconnection of the proper contact, respectively.

If the connecting cable 18 is intended to be equipped with a special line for checking short circuits or if an activating current is intended to flow via a current flow via the plug connection for connecting the monitoring sensor 20 to the theft protection system 10 and this current serves to activate the monitoring circuit 12 associated with the sensor 20 with the aid of the activation circuit 46, it is then recommendable to select a three-wire or four-wire connecting cable 18.

Figure 6:
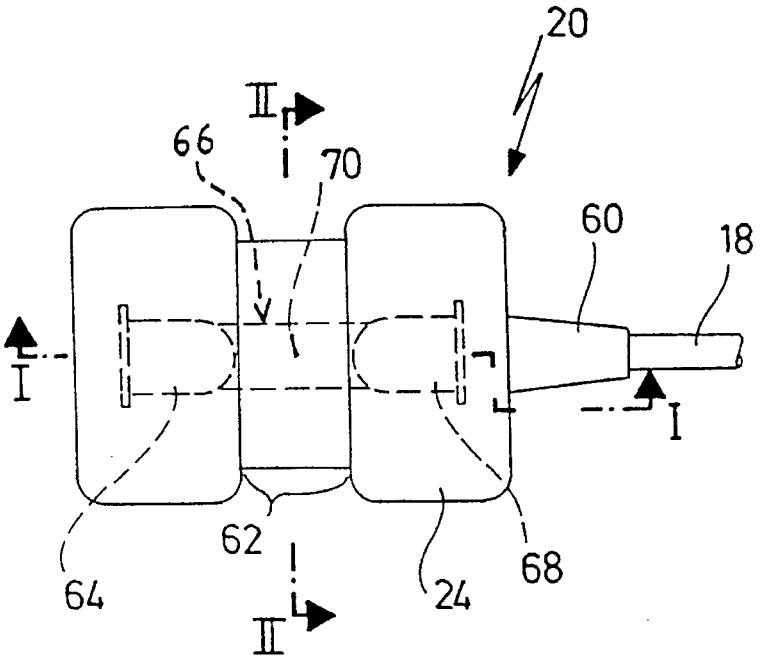
FIG. 6 is a plan view onto a third embodiment of an inventive monitoring sensor.

The third embodiment of the inventive sensor 20 is illustrated in a plan view in FIG. 6. The sensor 20 again has a housing 24 made of a rubber-elastic material. In this case, the connecting cable 18 is securely connected to the sensor 20 via an extension 60 of the housing 24.

Figure 7:
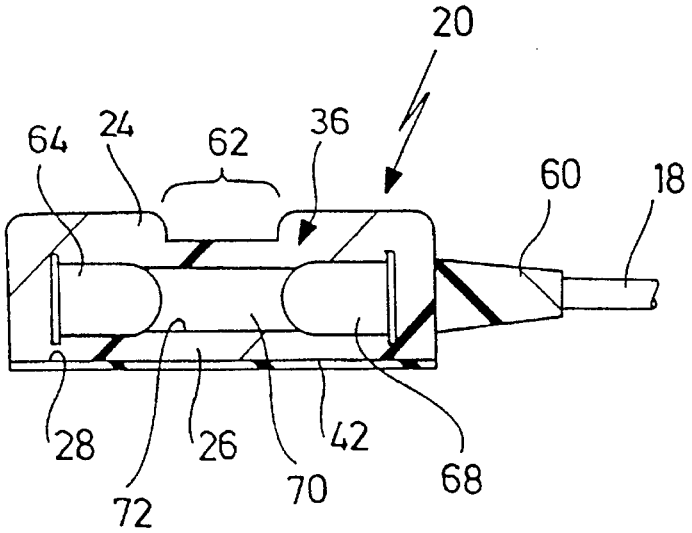
FIG. 7 is a longitudinal section of the sensor according to FIG. 6 along line I—I.

The housing 24 essentially has the shape of a flat rectangular parallelepiped, whereby its base is designed as contact surface element 26 having a contact surface 28 which is plane in the unattached state of the sensor 20, as shown in the longitudinal section according to FIG. 7 along line I—I in FIG. 6.

Furthermore, the housing 24 has a reduced cross section in a central section 62, transversely to the longitudinal extension of the parallelepiped. This is also apparent from FIG. 8 which shows a cross section of the sensor 20 along line II—II in FIG. 6. Accordingly, the housing 24 and the contact surface element 26 are particularly flexible in the narrowed section 62.

In the third embodiment, the sensor element 36 comprises a light emitter 64 in the form of a GaAs diode, a light transfer element 66 and a light receiver 68 in the form of a phototransistor. The light transfer element 66 is formed in this embodiment by a cavity as tubular conductor 70 having a circular cylindrical shape and extending in the longitudinal axis of the parallelepiped. The light emitter 64 and the light receiver 68 are arranged opposite one another at the two ends of the tubular conductor 70. Accordingly, the light transfer element 66 forms a light channel 72 between the light emitter 64 and the light receiver 68.

In this embodiment of the sensor 20, a dull-black rubber material is preferably used for producing the housing 24 and the contact surface element 26. Accordingly, the cylinder-shaped wall of the light channel 72 in the housing 24 is not or only slightly reflecting for light signals emitted from the light emitter 64. Therefore, the intensity received by the light receiver 68 is directly dependent on the inside cross section of the light channel 72. The light receiver 68 sends out a signal corresponding to the light received as measured variable of the sensor element 36.

Figure 8:
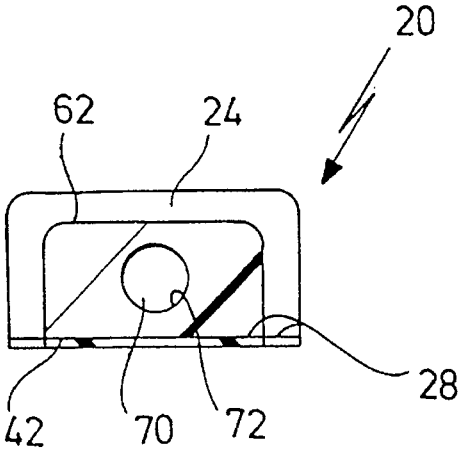
FIG. 8 is a cross section of the sensor according to FIG. 6 along line II—II.

In the third embodiment, the electrical connections for the light emitter 64 and the light receiver 68 are not illustrated in FIGS. 6, 7 and 8 for reasons of simplification.

It is clearly apparent from the longitudinal section according to FIG. 7 that with the preferred arrangement of the optical axis of the light transfer element 66 parallel to the contact surface 28 the lateral wall of the tubular conductor 70 is formed at least partially by the contact surface element 26. This means that alterations in the shape of the contact surface element 26 during attempts to disconnect the proper contact between sensor 20 and article 22 result directly in a change in the inside cross section of the light channel 72 so that the resulting change in the measured variable generated by the light receiver 68 can be detected by the monitoring circuit 12 of the theft protection system 10.

In order to reduce energy consumption, it has proven to be advantageous for the light emitter 64 to send out light pulses with a frequency of 10 Hz. These light pulses are received by the light receiver 68 and evaluated as to their intensity. In this respect, either a synchronized measurement by the light receiver 68 or an evaluation of the measured maximum intensities during a continuous measurement can take place.

It should also be mentioned that the sensor 20 of the third embodiment also has an adhesive layer 42 on its contact surface 28 so that it can be secured to the article 22 to be protected with the aid of the adhesive layer 42.

As for the rest, a processing and evaluation of the measured value can be provided either as in the first embodiment or as in the second embodiment.

In the light transfer element 66 as described, the light channel 72 formed therein extends in a straight line from the light emitter 64 to the light receiver 68. It is, however, also possible to design the light transfer element 66 such that a curved light channel 72 is formed. It is, in particular, possible to have a circular or annular design so that the light emitter 64 and the light receiver 68 can be arranged close to one another and opposite one another such that the light channel 72 extending in a circular shape forms a curved optical connection from the light emitter 64 to the light receiver 68.

In this case, the wall of the light channel 72 is designed to be only slightly reflecting, and the light transfer element 66 is preferably formed by a very thin and flexible tube, such as a capillary tube made of a not very elastic plastics material, the interior of which can, as it were, not be squeezed together. Such a tube is, for example, arranged in the edge region of a flexible sensor 20 designed as a circular disk. This results in the advantages that the sensor 20 in the state properly attached to the article 22 does not generate any false alarm in the case of a compressive load since the interior of the tube is not altered but that a removal of the sensor 20 from the article 22 will result in an alteration in the curvature of the tube due to its flexibility and, therefore, to an alteration in the light transmission characteristics and accordingly to an alteration in the measured variable supplied by the light receiver 68. This results in a reliable detection of attempts at theft.

In all the embodiments, the sensor elements 36 can be arranged, in particular, in the edge region of the contact surface element 26 in order to register the particularly great change in the shape of the contact surface element 26 in the edge region when the sensor 20 is separated from an article 22 to be protected. This leads to a particularly reliable detection of attempts at theft.

In addition to the uses of the monitoring sensors 20 as previously described for protecting articles 22 against theft, the sensors, in particular, of the second and third embodiments, which provide constantly changing measured variables as a function of alterations in the shape of the contact surface element 26, are generally suitable for measuring displacements or the like. The specified sensors 20 can, in particular, be used for measuring dilatations in the field of building construction. For example, a slowly advancing crack formation can be monitored with the aid of a sensor 20 stuck over the crack and, where necessary, an alarm can be given when a tolerance range is exceeded.

It is particularly important for the present invention that the monitoring sensor 20 itself need not have a rigid structure in order to preclude unintentional false alarms. On the contrary, the sensor housing 24 can be designed to be very flexible as a whole and is given a stable position by being adhered to a rigid surface in firm contact. This means that false alarms can be reliably ruled out even in the case of very flexible, in particular rubber-elastic sensor housings 24 having a slight thickness. It is, however, also possible to attach the sensor 20 with its flexible contact surface element 26 to a flexible article 22 when the sensor element 36 is designed, for example, as a flexible conductor loop 38 arranged between the adhesive layer 42 and the contact surface element 26 and the measured variable made available by this conductor loop does not alter essentially until the sensor 20 is removed from the article 22.

In any case, the flexible design of the sensor 20 results in a better connection being provided between the sensor 20 and the article 22 since the pressure exerted when the sensor 20 is adhered to the article 22 is not distributed over the entire contact surface 28 but a higher pressure results in defined areas. Where necessary, the sensor 20 is pressed onto the article 22 to be protected several times by an operator with his finger at different locations. This results in a considerably stronger and more durable adhesive contact between the sensor 20 and the article 22 to be protected than in the case of sensors having a rigid housing.

What is claimed is:

1. Monitoring sensor for an article (22) susceptible to theft, comprising a sensor element (36) for monitoring a proper secure attachment of the monitoring sensor (20) to the article (22) and a connecting cable (18) for connection of the sensor (20) to a monitoring circuit (12) of a theft protection system (10), wherein the sensor (20) makes a measured variable available during disconnecting of said attachment to the article (22), alteration in said variable being evaluated by the monitoring circuit (12) as a theft alarm situation, wherein the sensor (20) comprises a flexible contact surface element (26) abutting areally on the article (22) in the case of said attachment of the sensor (20) to the article (22), wherein the sensor element (36) is designed and arranged such that an alteration in the shape of the contact surface element (26) during disconnecting of said attachment of the sensor (20) to the article (22) results in an alteration in the measured variable, and wherein the sensor element (36) is deformable with the contact surface element (26) for adaptation to the shape of the article (22) and is arranged to extend essentially parallel to a contact surface (28) of the contact surface element (26).

2. Monitoring sensor as defined in claim 1, characterized in that the contact surface element (26) forms a flat side of the sensor (20), and that the sensor element (36) extends into edge regions of the contact surface element (26).

3. Monitoring sensor as defined in claim 1, characterized in that the contact surface element (26) is produced from a rubber-elastic material.

4. Monitoring sensor as defined in claim 1, characterized in that the sensor (20) comprises a flexible, preferably flat housing (24), and that the contact surface element (26) is designed in one piece with the housing (24).

5. Monitoring sensor as defined in claim 1, characterized in that the sensor (20) comprises an optical display (54) for the operational state of the sensor (20).

6. Monitoring sensor as defined in claim 1, characterized in that the sensor (20) comprises a rigid connecting part (30) for the connecting cable (18).

7. Monitoring sensor as defined in claim 1, characterized in that the sensor element (36) comprises a strain gauge (56).

8. Monitoring sensor as defined in claim 7, characterized in that the strain gauge (56) is integrated at least partially into the flexible contact surface element (26).

9. Monitoring sensor as defined in claim 1, characterized in that a circuit (52) is integrated into the sensor (20), said circuit processing said measured variable supplied by the sensor element (36) for the monitoring circuit (12).

10. Monitoring sensor as defined in claim 9, characterized in that the circuit (52) comprises an evaluation circuit (48) for processing the measured variable of the sensor element (36) and for converting the measured variable into a digital value as well as a storage means (50) for the intermediate storage of the digital value, wherein the circuit (52) processes the measured variable at predetermined time intervals and converts the measured variable into a digital value and transmits a signal indicating an alarm to the monitoring circuit (12) when the digital value intermediately stored differs from a most currently converted digital value by a predeterminable value.

11. Monitoring circuit for theft protection systems for use with a monitoring sensor as defined in claim 1, characterized in that the monitoring circuit (12) comprises an evaluation circuit (48) for processing the measured variable of the sensor element (36) and converting the measured variable into a digital value as well as a storage means (50) for the intermediate storage of the digital value, wherein the monitoring circuit (12) processes the measured variable supplied by the sensor element (36) at predetermined time intervals and converts it into a digital value and causes an alarm to be triggered when the digital value intermediately stored differs from a most currently converted digital value by a predeterminable value.

12. Theft protection system comprising a monitoring circuit (12) as defined in claim 11, characterized in that the theft protection system (10) comprises an activation circuit (46) for activating the monitoring circuit (12) allocated to a connection for receiving said connecting cable of the monitoring sensor (20) when the connection of said connecting cable (18) with said monitoring sensor (20) is made for the first time, wherein at a predetermined time interval from the activation of the monitoring circuit the monitoring circuit processes the measured variable of the sensor (20) for the first time, converts the measured variable and stores the converted value intermediately in the storage means (50).

13. Monitoring sensor as defined in claim 1, characterized in that the contact surface element (26) comprises an adhesive layer (42) for attachment of the sensor (20) to the article (22).

14. Monitoring sensor as defined in claim 13, characterized in that the adhesive layer (42) adheres more strongly to the article (22) than to the contact surface element (26) and the sensor element (36) comprising a measuring loop is integrated into the adhesive layer (42) so that during disconnecting of said attachment of the sensor (20) to the article (22), the sensor element (36) with the adhesive layer (42) are separated at least partially from the contact surface element (26) and as a result said measuring loop formed by the sensor element (36) is interrupted.

15. Monitoring sensor as defined in claim 14, characterized in that the sensor element (36) comprises a conductive electrical conductor loop (38) as said measuring loop.

16. Monitoring sensor as defined in claim 15, characterized in that the conductor loop (38) is contacted electrically via at least two contact points (34) integrated into the contact surface element (26).

17. Monitoring sensor as defined in claim 13, characterized in that the sensor element (36) is arranged between the adhesive layer (42) and the contact surface element (26).

18. Monitoring sensor as defined in claim 17, characterized in that the adhesive layer (42) adheres more strongly to the article (22) than to the contact surface element (26), and that the sensor element (36) comprising a measuring loop adheres to the adhesive layer (42) so that during disconnecting of said attachment of the sensor (20) to the article (22), the sensor element (36) with the adhesive layer (42) are separated at least partially from the contact surface element (26) and as a result said measuring loop formed by the sensor element (36) is interrupted.

19. Monitoring sensor as defined in claim 18, characterized in that the sensor element (36) comprises a conductive electrical loop (38) as said measuring loop.

20. Monitoring sensor as defined in claim 19, characterized in that the conductor loop (38) is contacted electrically via at least two contact points (34) integrated into the contact surface element (26).

* * * * *